US005154194A

United States Patent [19]

Ptschelinzew

[11] Patent Number: 5,154,194

[45] Date of Patent: Oct. 13, 1992

[54] METHOD FOR CREATING A PERMANENT HAIR WAVE

[76] Inventor: Alexander Ptschelinzew, 7 Samana Dr., Miami, Fla. 33133

[21] Appl. No.: 663,547

[22] Filed: Mar. 4, 1991

[51] Int. Cl.[5] ..... A45D 24/00

[52] U.S. Cl. ..... 132/200; 132/203

[58] Field of Search ..... 132/200, 203, 204, 207, 132/210, 222, 212, 246

[56] References Cited

U.S. PATENT DOCUMENTS

| | | | |
|---|---|---|---|
| 2,152,673 | 4/1939 | Solomon | 132/246 |
| 2,152,737 | 4/1939 | Holden | 132/226 |
| 2,489,120 | 11/1949 | Carlin | 132/246 |
| 2,518,262 | 8/1950 | Wilson | 132/210 |
| 2,663,302 | 12/1953 | Palitti | 132/246 |
| 4,540,006 | 9/1985 | Collis | 132/246 |
| 4,648,414 | 3/1987 | Fox et al. | 132/246 |

FOREIGN PATENT DOCUMENTS

| | | | |
|---|---|---|---|
| 0002903 | 10/1908 | United Kingdom | 132/246 |

*Primary Examiner*—John J. Wilson
*Assistant Examiner*—Frank A. LaViola

[57] ABSTRACT

The present invention comprises a method of using one continuous permanent wrap structure instead of a multitude of individual perm rods to create a permanent hair wave. This wrapping structure is preferentially made of rope but may also be a continuous piece of foam rubber, or rag, or the like. In fact, any device that would allow hair to be wrapped around it would suffice. By utilizing one continuous piece of rope as the perming rod, the time to prepare a scalp for perming solution is approximately one-half (½) of the time that it would take to place a multitude of smaller individual perm rods on one's head.

11 Claims, 3 Drawing Sheets

METHOD FOR CREATING A PERMANENT HAIR WAVE

FIELD OF INVENTION

This invention relates to a method for creating a permanent hair wave. More specifically, the effect of this method is to create a spiral curl in the hair once the method is applied.

BACKGROUND OF THE INVENTION

It is oftentimes desirous to apply a curl to straight hair. Individuals with straight hair tend to want to add a certain amount of body to the hair and this is accomplished by, among other ways, having a procedure known as a permanent wave or in the vernacular, a perm. The traditional procedure for perming one's hair has always included the placement of a multitude of hair wavers or perm rods or rollers within the hair. A number of these devices may be viewed in the following United States letters patents: U.S. Pat. Nos. 1,425,527; to H. H. Klein; U.S. Pat. No. 1,684,774; to H. M. Montealegre; U.S. Pat. No. 2,152,737 to J. W. W. Holden; U.S. Pat. No. 2,489,120 to A. S. Carlin; U.S. Pat. No. 2,663,302 to R. N. Palitti; U.S. Pat. No. 4,540,006 to Collis, and; U.S. Pat. No. 4,648,414 to Fox et al.

The method for creating a perm using the above referenced devices and devices of similar import and structure requires that each perm rod or roller have wrapped around it a wisp of hair. This procedure is repeated many times throughout the head. Upon conclusion, there exists a multitude of perm rods having a wisp hair wrapped around each one, and these perm rods can number more than one hundred (100) depending upon the length of hair. Once the perm rods are in place, a perm solution is applied to break the bonds of the hair so that the hair may conform to the shape of the rod. Thereafter, the procedure of waving or curling one's hair requires that the rods be rinsed of the perm solution with tap water. Each rod is thereafter blotted with a towel to remove excess water. Finally, a neutralizer solution is then added which rebonds the hair around each perm rod thus causing the desired curl effect. As one can imagine, the amount of time and detail required to place so many rods on one's hair is very time consuming and tedious. In fact, a conventional perm takes approximately one (1) to two (2) hours to set all of the rods in place. In addition, with a large number of perm rods in one's hair, it is easy to miss the application of a rod or rods with the perm solution or neutralizer. As a result, the hair oftentimes does not receive the same amount of curl from the root to the end. The hair also does not receive the same curl from the root to the end because conventional methods require that the hair be completely overlapping when rolled thus preventing solution from reaching the end of the hair which is rolled first. This is a significant disadvantage because it is the end of the hair which should primarily receive the curl effect of the perm as that is the portion that exudes the visual appearance of the curl.

An additional disadvantage of the present method of perming hair is again caused by the quantity of rods used. This disadvantage occurs because the natural order of applying solution requires that some rods receive perm solution for longer periods of time than other rods. This causes excessive curl on some portions of the hair and less curl on other portions of the hair.

The uneven curl resulting effect is highly problematic of present methods.

Still another disadvantage of the present method of creating a permanent wave in one's hair is the discomfort occassioned by the multitude of perm rods located on the head once it is prepared to receive the perm solution. Also, a head with perm rods attached thereon is exceedingly displeasant from an aesthetic point of view.

SUMMARY OF THE INVENTION

The present invention overcomes the disadvantages of the prior art by using one continuous permanent wrap structure instead of a multitude of individual perm rods. This wrapping structure is preferentially made of rope but may also be a continuous piece of foam rubber or rag or the like. In fact, any device that would allow hair to be wrapped around it would suffice. The preference of a rope is based upon the natural intertwined fibers that shape the rope into a spiral design. By utilizing one continuous piece of rope as the perming rod, the time to prepare a scalp for perming solution is approximately one-half (½) of the time that it would take to place a multitude of smaller individual perm rods on one's head.

An additional advantage of the method of using a singular long rope-like permanent wrap to achieve a spiral curl effect is that the rope, when twisted about the hair, lies flat to the head. This provides for a much easier application of the perming and neutralizing solutions to take effect and work effectively. This is due to the close position of the rope with respect to the scalp, and the singularity of the wrap as opposed to numerous rods. Another advantage is that with this singular rope perm wrap, there is a much smaller chance of incorrectly applying too much or too little perm solution or neutralizer since the solutions are applied to just the one long wrap; there are fewer nooks and crannys that miss the application of solution. This prevents uneven curl as has been occasioned by the traditional prior art methods of perming hair.

Still another advantage of the present method is that the size of the curl may be determined by the size of the continuous rope perm rod. The larger the rope's diameter, the larger the curl. Similarly, the smaller the diameter of the rope, the tighter the spiral curl.

Still another advantage of the present invention is to provide for a more even curl from the roots to the end of the hair. This is occasioned because the hair is wrapped around the rope from roots to ends and not from ends to roots as conventionally done. Also, the present method allows for a partial overlapping of wisps of hair around the wrap which enables more solution to actually reach the hair.

Still another advantage of the present invention is that once wrapped, the presentation is much neater, more attractive and cleaner to the recipient of the method and is thus more comfortable than the prior art method. A large number of rods do not dangle from the recipient's head causing discomfort.

BRIEF DESCRIPTION OF THE DRAWINGS

The features embodying the present invention are illustrated in the accompanying drawing forming a part of this application, in which.

DETAILED DESCRIPTION OF A PREFERRED EMBODIMENT

Figure 10:
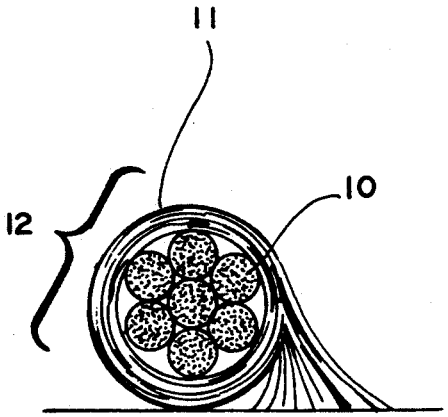
FIG. 10 is a cross section view taken at line 10 of FIG. 6.

For the sake of convenience, reference is made to a piece of rope 10 as a continuous permanent wrap. The wrap, however, may be made of a continuous piece of foam rubber or similar device that is used for perming one's hair 11. It is preferred that the rope 10 has sufficient length to cover one's head. However, the length of the rope 10 naturally will be dictated by the length needed to finish wrapping all of the hair 11. It has been found that a rope 10 of ten feet in length is desirable. Additionally, the diameter 12 of the rope 10 depends upon the size of the curl desired. (See FIG. 10). If a larger curl is desired, a larger diameter rope is used. If a smaller curl is desired, or, in other words, a tighter curl, then a smaller diameter rope is used. Rope 10 is a preferred embodiment as the continuous wrap because it lends itself to a spiral curl through the twisting shape of the fibers in the rope.

Figure 1:
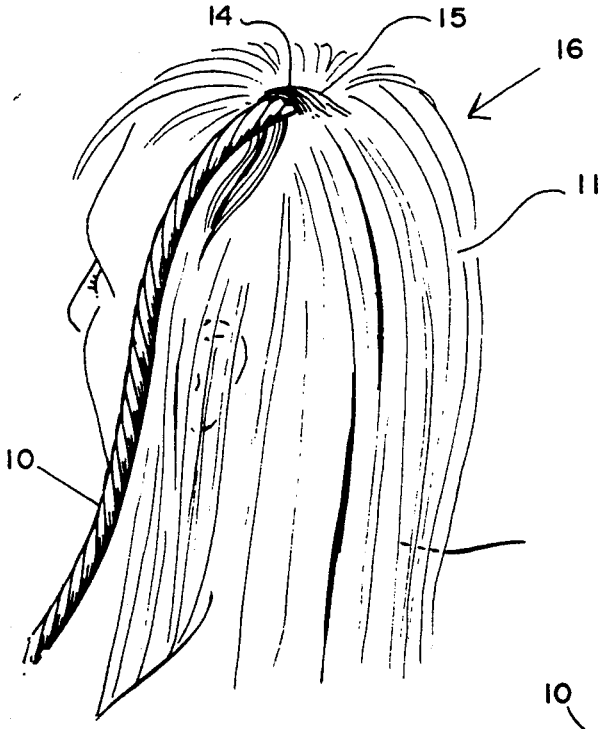
FIG. 1 is a back perspective view showing the first step of the method of the present invention.
Figure 2:
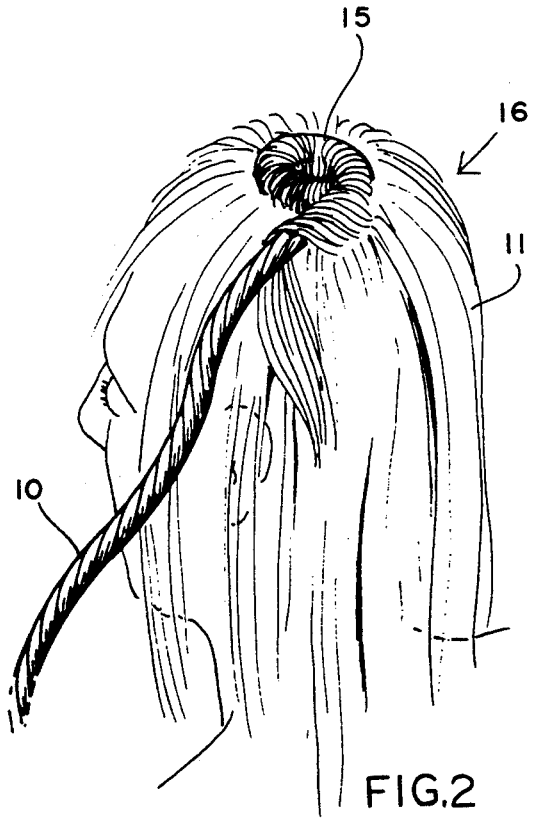
FIG. 2 is a back perspective view showing the second step of the method of the present invention.
Figure 3:
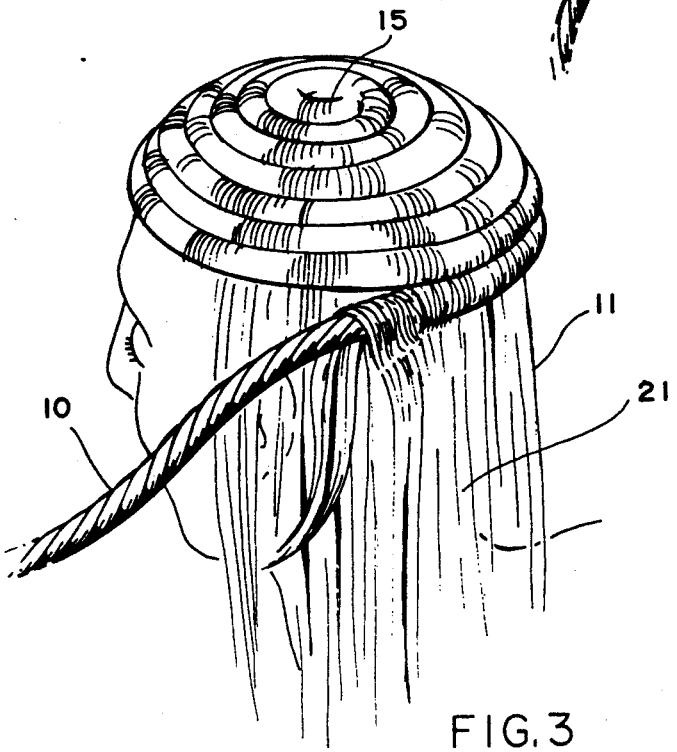
FIG. 3 is a back perspective view of succeeding stages of the method of the present invention.
Figure 6:
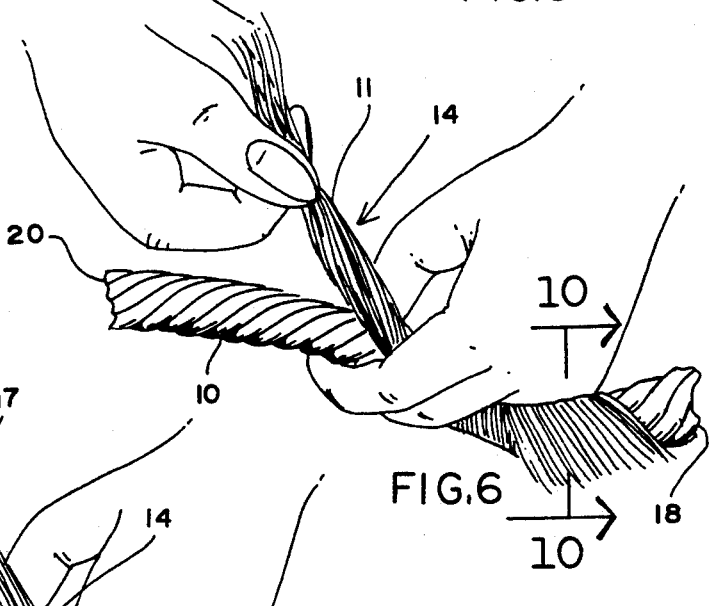
FIG. 6 is a fragmented front plan view of the first stage of the method of the present invention.

The principal and preferred method of practicing this invention, as depicted in FIG. 1, dictates that the first section wisp 14 of hair 11 be wrapped around the rope 10 starting at the crown 15 or top of the head 16. Each wisp of hair is approximately going to be a one square inch section depending upon the length and thickness of hair and style of haircut. Taking the first one square inch section wisp 14 of hair 11 at the crown 15, the individual applying the rope to the hair will wrap that wisp 14 around the front end 18 of the rope 10, as seen in FIG. 6, keeping the rope close to the scalp. When wrapping the hair, the hair 11 may be twisted when being wrapped (See FIG. 6). This twisting is useful to keep the ends of the hair together especially when the hair 11 is shorter and/or layered. The hair 11 is wrapped in a progressively forward spiralling motion, as seen in FIGS. 2 and 3, with no spacing between each wrapped section of the hair wisp 14. Caution is suggested at this stage because if the hair is spaced on the rope, there can be a loss of curl. An additional caveat at this point is to be made. It is important not to wrap the hair completely on top of itself because that will also cause a loss of spiral curl.

Figure 7:
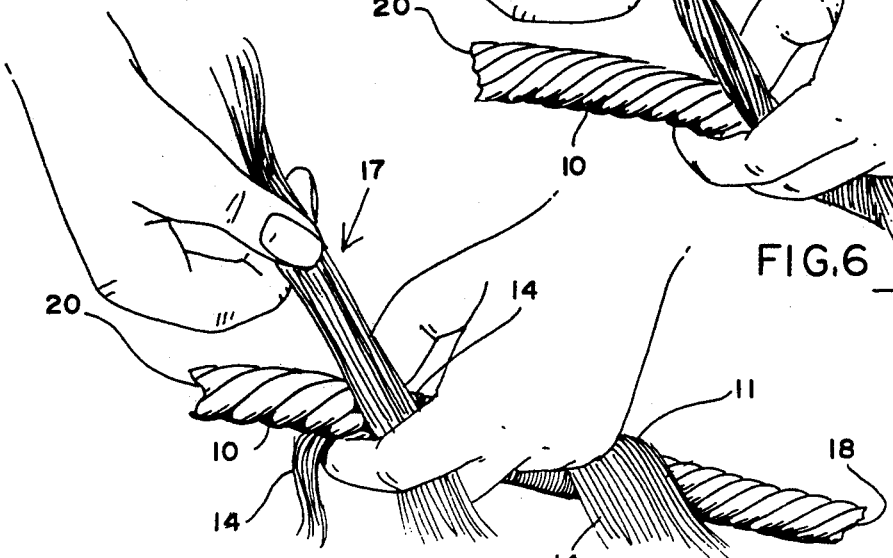
FIG. 7 is a fragmented front plan view of the second stage of the method of the present invention.

After wrapping approximately one half of the first square inch section of hair 11 in a tight progressive forward spiralling motion toward the back end 20 of rope 10, incorporate the next, second square inch section wisp 17 of hair together with the first (See FIG. 7). This succeeding section 17 of hair will initially be wrapped around the previous (first) section 14 of hair 11 and will be wound tightly in the same forward spiralling progressive manner in which the first section 14 was wrapped. It is suggested that each section of hair be wrapped around the rope two to three times depending upon the diameter of the rope 10 and length of hair 11.

Figure 4:
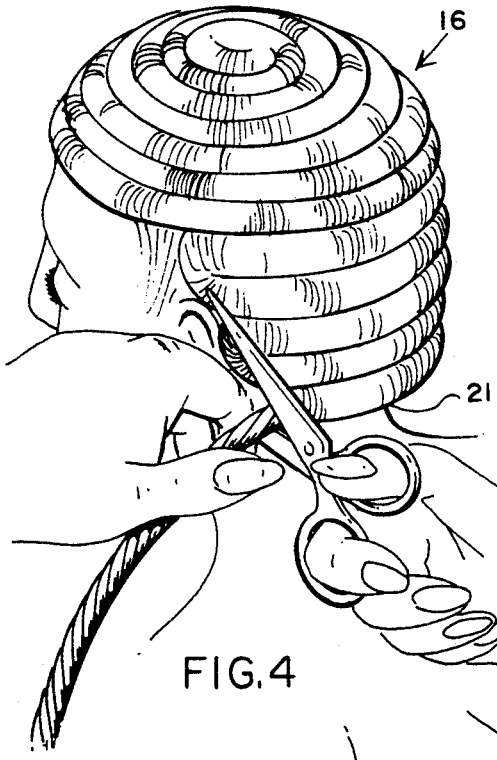
FIG. 4 is a back perspective view showing the finishing stage of the method of the present invention.
Figure 5:
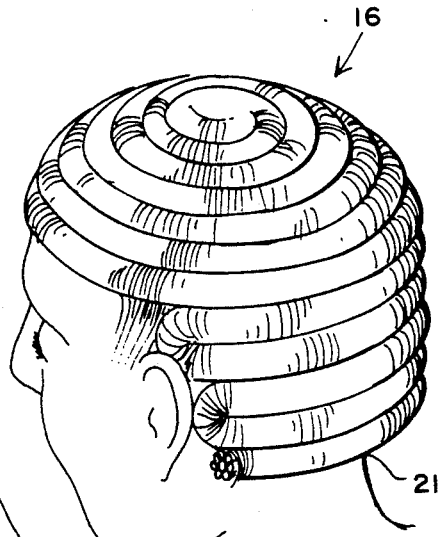
FIG. 5 is a back perspective view showing the completed method of the present invention.

For each succeeding square inch section of hair, the same method is applied such that a coil design is created from the crown 15 of the head. This coil as seen partially in FIG. 3 and fully in FIGS. 4 and 5 is created by taking sections forward and around the first row at the crown 15 of the head and continuing to make the coil bigger around the head to the nape 21 of the neck.

If there is any rope 10 that extends beyond the last section of hair wrapped around it, simply wrap a piece of tissue around the last wisps and clamp the hair 11 and rope 10 with a hair clip (not shown) or other securing means to prevent the hair 11 from unraveling. Then simply cut the remaining portion of the rope and discard it as depicted in FIG. 4. The hair 11 is then prepared for the conventional perming solutions.

Figure 8:
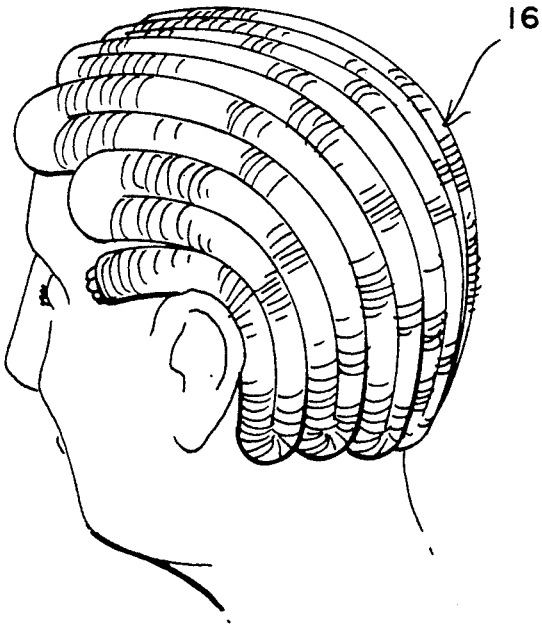
FIG. 8 is a back perspective view of the completed method of an alternative embodiment of the present invention.
Figure 9:
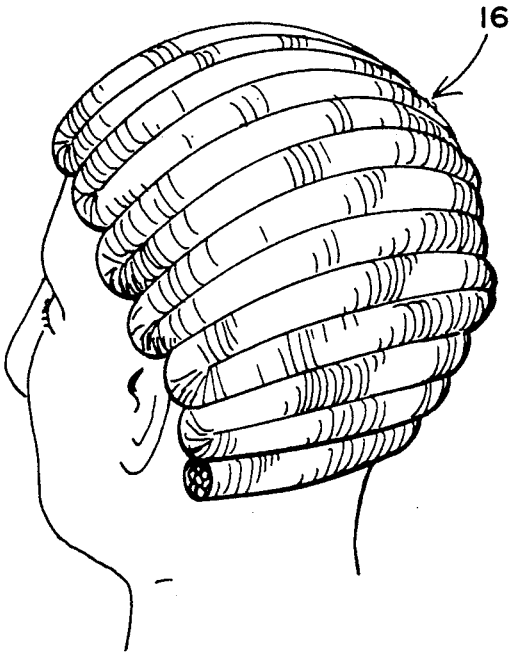
FIG. 9 is a back perspective view of the completed method of an alternative embodiment of the present invention.

While the above description identifies the preferred method of creating a permanent hair wave with a sprial curl effect, the method can be similarly accomplished while utilizing a different pattern other than a coil design. For example, FIGS. 8 and 9 depict the wrapping or spiralling of the rope 10 in an "S" pattern starting from the side of the head by the ear or the forehead, respectively. Other designs are also possible.

Figure 11:
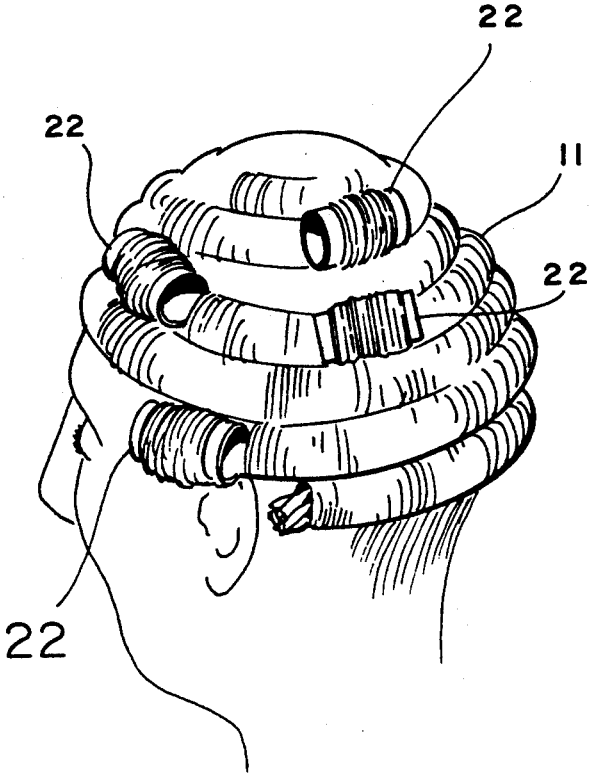
FIG. 11 is a back perspective view showing the completed method, with perm rods, of the present invention.

If non self-timing perm solutions are used, the head of hair 11 may be completely wrapped around with rope 10 but interspersed through the coil or other design will be perm rods 22 of conventional structure. (See FIG. 11). These perm rods may be intermittently unrolled to test the efficacy of the curl desired after solution is applied. It is suggested that about four of these perm rods 22 be placed throughout the head 16 in different locations. Further, if the hair 11 is shorter around the hairline or nape 21 of the neck, it may be difficult to wrap such short hair around the rope perm wrap 10. Therefore, it is suggested that individual strips of rope or conventional perm rods be placed at these locations if curl is preferred.

The foregoing figures and descriptions thereof are provided as illustrative of some of the preferred embodiments of the concepts of this invention. While these embodiments represent what is regarded as the best modes for practicing this invention, they are not intended as limiting the scope of the invention which is set forth in the following claims.

What is claimed:

1. A method for creating a permanent wave with a spiral curl effect, said method comprising the steps of:

using one continuous permanent wrap sufficient in length to have all the hair of one's head wrapped about it, taking approximately a first one square inch section of hair at a time and wrapping it around said permanent wave wrap until one half of the hair length of the first section is wrapped, thereafter taking an adjacent approximate second one square inch section of hair and wrapping it around said permanent wave wrap such that said second section of hair is partially wrapped around said first section until approximately one half of said second section of hair is wrapped around said permanent wave wrap, wrapping succeeding adjacent approximate one inch square sections of hair until the entire head of hair is wrapped around said permanent wave wrap, and cutting off excessive permanent wave wrap not utilized and covering the end portion of hair with a tissue and clipping said end portion of hair in place.

2. In the method of claim 1, said permanent wave wrap being comprised of a rope.

3. In the method of claim 1, said wrap being comprised of a continuous piece of foam rubber.

4. In the method of claim 1, said wrap being comprised of a continuous structure wherein said continuous structure is a rod used for curling hair.

5. In the method of claim 1, the said approximate first one inch square section of hair is taken from the crown of the head.

6. The method of claim 1, further comprising the step of twisting each said section of said hair while wrapping each said section around said permanent wrap.

7. The method of claim 1, further comprising the step of wrapping said hair in a progressively forward spiralling design that substantially creates a coil design.

8. The method of claim 1, further comprising the step of wrapping said hair beginning at a position other than the crown of the head to create a design other than a coil.

9. The method of claim 1, further comprising the step of interspersing a plurality of rods throughout the permanent wrap when non-self timing permanent solutions are used.

10. In the method of claim 9, the number of said plurality of rods being four.

11. The method of claim 1, further comprising the step of omitting shorter hair around the hair line of the neck from said permanent wrap and wrapping the said shorter hair with individual strips, said individual strips selected from the group comprising: smaller permanent wraps and rods.

* * * * *